United States Patent [19]

Levine

[11] Patent Number: 5,056,178

[45] Date of Patent: Oct. 15, 1991

[54] PLUMBING TOOL WHICH HAS A NOVEL CHUCK AND METHOD OF JOINING THE SHAFT TO THE CASE

[76] Inventor: Aaron J. Levine, 3180 N. Lake Shore Dr., Apt. 5A, Chicago, Ill. 60657

[21] Appl. No.: 519,393

[22] Filed: May 4, 1990

[51] Int. Cl.[5] ..... B08B 9/02

[52] U.S. Cl. ..... 15/104.33; 279/69

[58] Field of Search ..... 15/104.33; 279/69

[56] References Cited

U.S. PATENT DOCUMENTS

| | | | |
|---|---|---|---|
| 1,497,483 | 6/1924 | Callender et al. | 279/69 X |
| 2,061,398 | 11/1936 | Green | 279/69 X |
| 2,266,659 | 12/1941 | Robinson et al. | 15/104.33 X |
| 2,467,849 | 4/1949 | O'Brien et al. | 15/104.33 |
| 3,727,261 | 4/1973 | Levine | 15/104.33 |

FOREIGN PATENT DOCUMENTS

| | | | |
|---|---|---|---|
| 113800 | 10/1900 | Fed. Rep. of Germany | 279/69 |
| 1118126 | 6/1968 | United Kingdom | 15/104.33 |

*Primary Examiner*—Edward L. Roberts

*Attorney, Agent, or Firm*—Hill, Van Santen, Steadman & Simpson

[57] ABSTRACT

A plumbing cleanout tool which has a flexible snake which includes a novel chuck that has a conical opening for driving and locking the chuck to the snake and which has a novel casting for attaching the storage drum to a hollow shaft through which the snake extends.

7 Claims, 1 Drawing Sheet

PLUMBING TOOL WHICH HAS A NOVEL CHUCK AND METHOD OF JOINING THE SHAFT TO THE CASE

BACKGROUND OF THE INVENTION

1. Field of the Invention

This invention relates in general to a plumbing tool and in particular to a motor driven plumbing tool which drives a hollow shaft through which a plumber's flexible sewer cleanout rod may be extended.

2. Description of the Prior Art

U.S. Pat. No. 3,727,261 in which the inventor is Aaron J. Levine, the inventor of the present application shows a plumbing tool of which the present application is an improvement. See also U.S. Pat. Nos. 4,763,374 and 4,793,017.

SUMMARY OF THE INVENTION

The present invention comprises a novel chuck for locking a hollow driving shaft of a plumbing tool to the snake of the plumbing tool and which has a tapered surface that is threaded to the shaft so that as the chuck is rotated, the tapered surface will drive holding and locking pins into the snake to lock it relative to the hollow shaft. Also, there is provided a novel method of joining the shaft to the drum by casting.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

DESCRIPTION OF THE PREFERRED EMBODIMENTS

Figures 1, 2, 3, 4, 5, 6, 7:
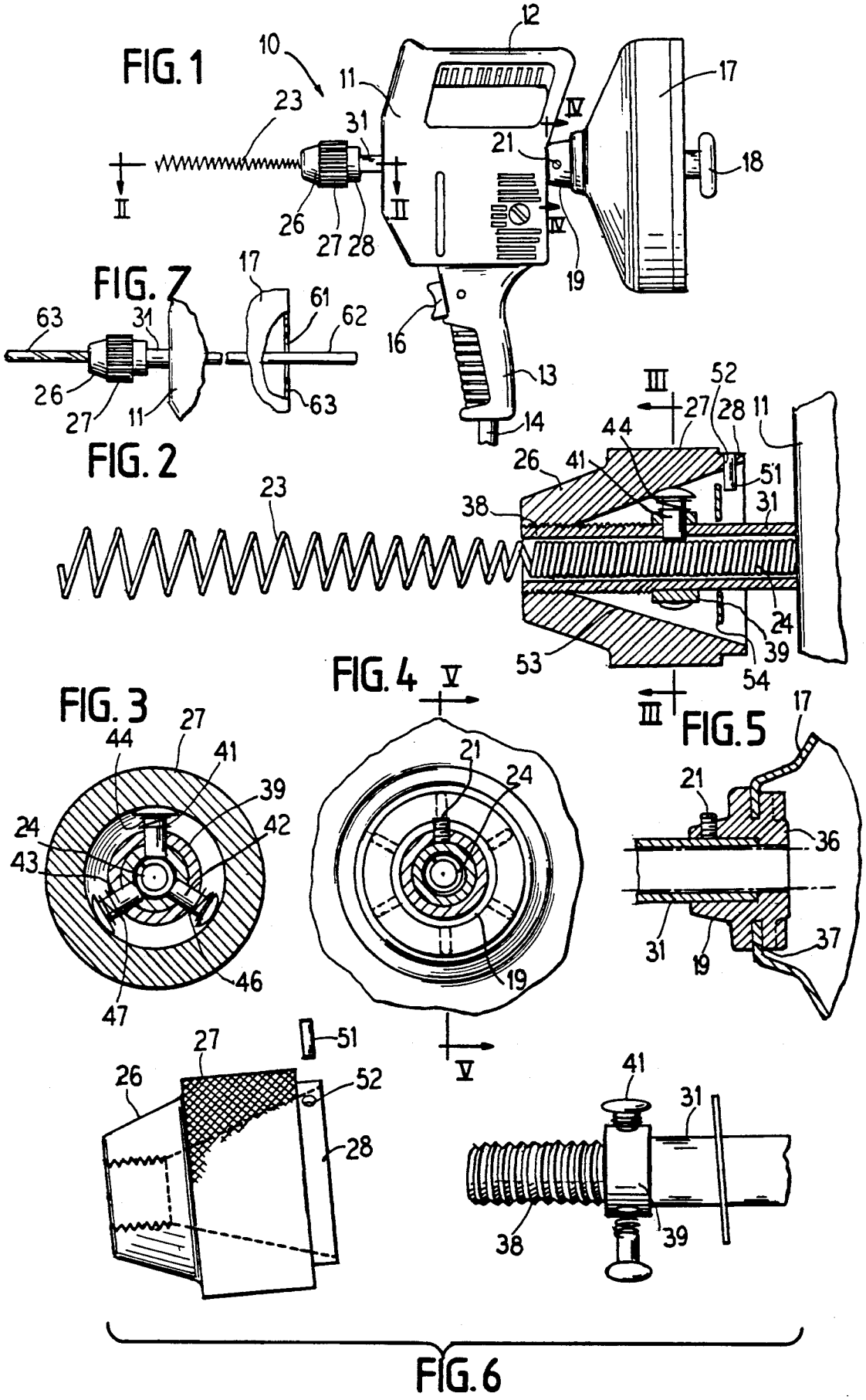
FIG. 1 is a side plan view of the plumbing tool of the invention.
FIG. 2 is a sectional view through the chuck of the invention.
FIG. 3 is a sectional view taken on line III—III in FIG. 2.
FIG. 4 is a sectional view taken on line IV—IV in FIG. 1.
FIG. 5 is a sectional view taken on line V—V in FIG. 4.
FIG. 6 is an exploded view of the novel chuck of the invention.
FIG. 7 shows a modification.

FIG. 1 illustrates a plumbing tool 10 of the invention which comprises a main body portion 11 in which a motor is mounted which drives a hollow shaft 31. An upper handle 12 is provided on the body member 11 and a lower handle 13 is connected to a power cord 14 and has a motor drive switch 16.

A drum 17 is connected to the rear portion of the hollow shaft 31 by a casting 19 which is provided with a threaded opening into which a locking set screw 21 is received. The rear portion 36 of the casting 19 is cast around the ends 37 of the drum 17 as shown in FIG. 5. The drum 17 is provided with a handle 18.

The front end of hollow shaft 31 is provided with a threaded portion 38 upon which a chuck is threadedly received. The forward portion 26 of the chuck is threaded so as to mate with the threaded portion 38 and a hollow conical internal opening 53 is formed in the chuck as shown in FIG. 2. A knurled hand portion 27 adjoins the front portion 26 and a rear portion 28 adjoins the hand portion 27 as shown in FIG. 2. A flexible snake 24 is stored in the drum 17 and extends through the hollow tube 31 and has a outer end 23. A plurality of locking pins as, for example, the three locking pins 41, 42 and 43 illustrated in FIGS. 2 and 3 extend through a collar 39 attached to the hollow shaft 31 and through openings formed in the hollow shaft 31 so that their inner ends engage flexible snake 24. The tapered portion 53 can be moved to the right relative to FIG. 2 by rotating it so as to cause the locking pins 41, 42 and 43 to engage and lock the snake 24. Biasing springs 44, 46 and 47 bias the locking pins 41, 42 and 43 in the outward direction against the tapered surface 53. An opening 52 is formed in the portion 28 of the chuck and a compression pin 51 is press fitted into the opening 52 and has an inner end which extends into the tapered opening 53 of the chuck.

A washer 54 is mounted on the shaft 31 between the pin 51 and the collar 39 so as to hold the chuck on the pins 41, 42, and 43 so that the tapered portion 53 will prevent the pins from falling from the assembly and out of the chuck.

It is to be realized that the pin 51 is placed in the opening 52 after the chuck has been assembled.

So as to cast the drum 17 to the hollow shaft 31 as shown in FIG. 5, the drum 17 and shaft 31 are held at a mold and the casting 19 is poured in a liquid state and allowed to solidify to form the cast portion 19 with the inner portion 36 which surrounds the ends 37 of the drum 17. Then the threaded opening for the locking pin 21 is formed in the casting 19 and the pin 21 is inserted and tightened so as to lock the hollow shaft 31 to the casting 19. Then the pins 41, 42 and 43 with their associated springs 44, 46 and 47 are placed in the openings formed in the collar 39 and the chuck 26 is threaded onto the threaded portion 38 so that the tapered portion 53 engages the heads of the pins 41, 42 and 43. The washer 54 has been previously mounted on the shaft 31 and the locking pin 51 is inserted through the opening 52 so that its inner end extends inwardly so as to engage the washer 54 to thus prevent the chuck 26 from being unthreaded from the threaded portion 38 so that the pins 41, 42 and 43 will not fall out of the openings of the collar 39. In other words, the pin 51, and washer 54 limit the distance that the chuck 26 can move to the left relative to FIG. 2. In use, the chuck 26 is rotated to move it to the left relative to FIG. 2 on the threaded portion 38 so that the pins 41, 42 and 43 will release their locking grip of the snake 24 so that the snake 24 can be pulled from the drum 17. When the desired length of snake 24 has been removed from the drum 17, the chuck 26 can be rotated so as to move it to the right relative to FIG. 2 thus causing the surface 53 to force the pins 41, 42 and 43 into engagement with the snake 24 to lock it to the hollow shaft 31. Then the plumbing tool may be used in the conventional manner by actuating the drive motor with the switch 16. After the plumbing tool has been used, the chuck 26 may be moved to the left and the flexible snake 24 may be pushed to the right relative to FIG. 2 so as to store it in the drum 17 and the chuck 26 may then lock the pins 41, 42 and 43 to the flexible snake 24 in the stored position.

FIG. 7 illustrates a modification of the invention in which the handle 18 is removed from drum 17. An opening 61 is formed in the rear wall 63 of the drum 17 when the handle 18 is removed. A snake 24 which is too long to be stored in drum 17 can be inserted through tube 31 and the chuck 27 to allow a long snake to be extended from the tool. Also, the snake can be removed and other tools such as a drill 62 can be inserted into opening 61, through tube 31 and the chuck 27. Different lengths of the drill can be extended from chuck as shown.

Although the invention has been described with respect to preferred embodiments, it is not to be so limited as changes and modifications can be made which are within the full intended scope of the invention as defined by the appended claims.

I claim:

1. A power tool comprising a main body portion, a hollow shaft rotatably supported by said main body portion and with one end externally threaded, a hollow storage drum connected to the second end of said hollow shaft, a snake extending through said hollow shaft and into said storage drum, a chuck formed with an internal threaded opening that fits over said one externally threaded end of said hollow shaft, a conical opening formed in said chuck, at least one locking pin extending through an opening formed in said hollow shaft and with one end engageable with said snake and a second end engageable with aid chuck within said conical opening of said chuck, and including means for limiting the movement of said chuck relative to said hollow shaft so as to prevent said locking pin from being removed from said hollow shaft.

2. A power tool according to claim 1 including a biasing spring mounted between said locking pin and said hollow shaft so as to bias said locking pin away from said snake.

3. A power tool according to claim 1 including three locking pins extending through said hollow shaft with their inner ends engageable with said snake and their outer ends engageable with said chuck within said conical opening.

4. A power tool according to claim 1 including a collar attached to said hollow shaft and formed with an opening which is aligned with said opening formed in said hollow shaft through which said locking pin extends.

5. A power tool according to claim 1 wherein said hollow storage drum and said hollow shaft are connected together by a casting.

6. A power tool according to claim 1 wherein said hollow storage drum is formed with a rear opening.

7. A power tool according to claim 1 in which said snake can be removed from said power tool and replaced with a rigid tool.

* * * * *